United States Patent [19]

Wronkiewicz et al.

[11] Patent Number: 4,953,471

[45] Date of Patent: Sep. 4, 1990

[54] FRICTION SHOE ASSEMBLY FOR REPAIR OF WORN RAILWAY TRUCK

[75] Inventors: Robert D. Wronkiewicz, Park Ridge; Charles Moehling, Arlington Heights, both of Ill.

[73] Assignee: AMSTED Industries Incorporated, Chicago, Ill.

[21] Appl. No.: 389,410

[22] Filed: Aug. 4, 1989

[51] Int. Cl.[5] ..... B61F 5/12

[52] U.S. Cl. ..... 105/198.4; 267/205

[58] Field of Search ..... 105/197 A, 197 D, 197 DB, 105/198, 198.2, 198.4, 198.5, 198.7; 267/205

[56] References Cited

U.S. PATENT DOCUMENTS

| | | | |
|---|---|---|---|
| Re. 31,784 | 1/1985 | Wiebe | 105/197 DB |
| Re. 31,988 | 9/1985 | Wiebe | 105/197 DB |
| 3,517,620 | 6/1970 | Weber | 105/198 |
| 3,901,163 | 8/1975 | Neumann | 105/197 DB |
| 4,103,623 | 8/1978 | Radwill | 105/197 DB |
| 4,109,585 | 8/1978 | Brose | 105/197 DB |
| 4,256,041 | 3/1981 | Kemper | 105/197 DB |
| 4,274,340 | 6/1981 | Neumann | 105/197 DB |
| 4,825,776 | 5/1989 | Spencer | 105/198.5 |

OTHER PUBLICATIONS

Stucki Friction Shoe, A. Stucki Co., Pittsburgh, Pa., (RFE-18 Elastowedge TM Resilient Column Friction Snubbing System).

*Primary Examiner*—Andres Kashnikow
*Assistant Examiner*—A. Muratori
*Attorney, Agent, or Firm*—Edward J. Brosius; Charles E. Bouton

[57] ABSTRACT

A method of repairing railway trucks in which the sloped surfaces of the truck bolster ends have become worn during service is provided that avoids the hetertofore required restoring of the sloped surfaces with weld material. An improved replacement friction shoe having tapered elastomeric pads which conform to the abutting service worn sloped surfaces of the bolster ends is installed to greatly reduce further wear on the bolster ends.

12 Claims, 3 Drawing Sheets

FRICTION SHOE ASSEMBLY FOR REPAIR OF WORN RAILWAY TRUCK

BACKGROUND OF THE INVENTION

The present invention relates generally to the repair of railway trucks and, more particularly, to a replacement friction shoe having a tapered, resilient elastomeric pad on the sloped surface thereof.

Friction shoe assemblies are incorporated in a railway truck in order to reduce instabilities in a railway vehicle.

Railroad trucks are well known and comprise, in part, a pair of spaced side frames connected by a transversely positioned bolster having its ends resiliently supported in the side frames respectively. The bolster, in turn, supports a body of the railroad vehicle which is cushioned by the resilient bolster side frame connection. A friction shoe is placed between each side frame column and the adjacent truck bolster end. Accordingly, each bolster end includes two friction shoe pockets, each comprising at least one sloped surface against which a corresponding sloped surface of the friction shoe abuts. The friction shoe also includes a generally flat, generally vertical face which abuts a friction wear plate welded and/or bolted to each side frame column.

Further, the damping effect of the friction shoe surfaces against both the sloped surfaces of the bolster end and the side frame column friction plates tend to provide a force to damp the oscillations of the bolster relative to the side frame to lessen the dynamic motions of the freight car.

A problem which occurs in this arrangement is that the sloped surfaces of the friction shoes tend to wear away the metal on the corresponding sloped surfaces of the bolster end. Excessive wear in the sloped surfaces of the bolster end requires that the bolster end be restored with weld material and eventually requires the replacement of the bolster, as repeated repair of such surfaces is expensive and impractical.

It has been discovered that providing the sloped surfaces of the friction shoe with elastomeric pads, such as is shown in U.S. Pat. No. 4,825,776, greatly lessens the possibility of the friction shoe wearing away the bolster end. In these combinations, the sloped surfaces of the friction shoes are adapted for securement of the elastomeric pads and said friction shoe/elastomeric pad combinations are commercially available. However, in order to incorporate a friction shoe with such prior art elastomeric pads into a service worn bolster end, the bolster end still has to be restored with weld material.

SUMMARY OF THE INVENTION

Accordingly, an object of the present invention is to provide a method for repairing a railway truck in which the sloped surfaces of the truck bolster end have become deformed by in service wear without restoring the worn surfaces with weld material.

A further object of the proposed invention is to provide a replacement friction shoe with tapered elastomeric pads which abut and conform to the surface of the sloped surfaces of the bolster end to greatly reduce further wear of the sloped surfaces of the bolster end.

By the present invention, it is proposed to overcome the difficulties encountered heretofore. To this end, it has been discovered that replacing an existing friction shoe in a railway truck in which the bolster ends have been deformed by in service wear with a friction shoe having an existing casting similar to that previously discussed and shown in U.S. Pat. No. 4,825,776 but having tapered elastomeric pads on the sloped surfaces thereof avoids the need to restore the bolster ends with weld material. The elastomeric pads are trapezoid shaped having a greater thickness at their upper ends than their lower ends such that, upon securing of the elastomeric pads to the sloped surfaces of the friction shoe and insertion of the shoe into the bolster, the top surfaces of the elastomeric pads will generally correspond to the abutting service worn sloped surfaces of the bolster ends. The elastomeric pads are also thicker in overall cross-section than prior art elastomeric pads in order to accommodate the overall reduction in thickness of the worn sloped surfaces of the bolster ends. Such an arrangement will continue to provide the desired damping affects without further substantial wear to the bolster ends.

DESCRIPTION OF THE PREFERRED EMBODIMENT

Figure 1:
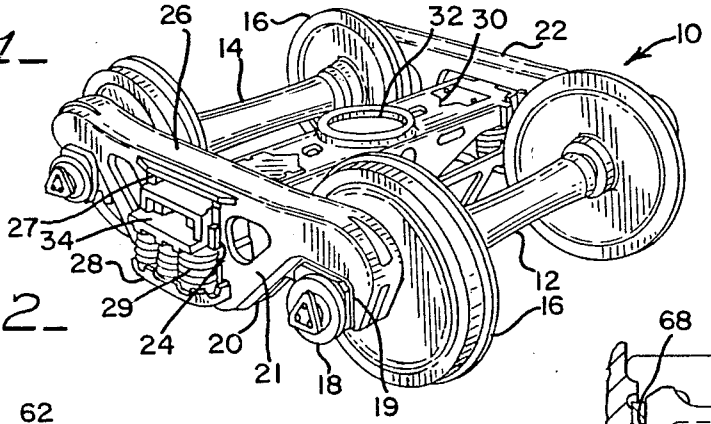
FIG. 1 is a perspective view of a railway truck.

Referring now to FIG. 1 of the drawings, a typical railway truck is shown generally at 10. The truck comprises a pair of axles 12 and 14, each of which support two railway wheels 16. The end of each of axles 12 and 14 include roller bearing assemblies 18 which are mounted in a pedestal jaw opening 19 in side frames 20 and 22. It will be understood that all features of side frame 20 are also present in side frame 22, but are not visible in FIG. 1. Side frame 20 is comprised of tension members 21 extending downwardly from pedestal jaw opening 19, side frame columns 24 extending upwardly from the lower portion of tension members 21 to the compression member 26 which is the uppermost portion of side frame 20. Side frame columns 24 are generally vertical and form a bolster opening 27 therebetween. A bottom spring support shelf 28 extends outwardly from a lower section of side frame 20 to receive the bottom end of spring group load coils 29. A bolster 30 extends parallel to axles 12 and 14 and has ends each extending through one of the side frame bolster openings 27. Each bolster 30 includes a center plate 32 through which the freight car body bolster center plate (not shown) is received.

Figure 2:
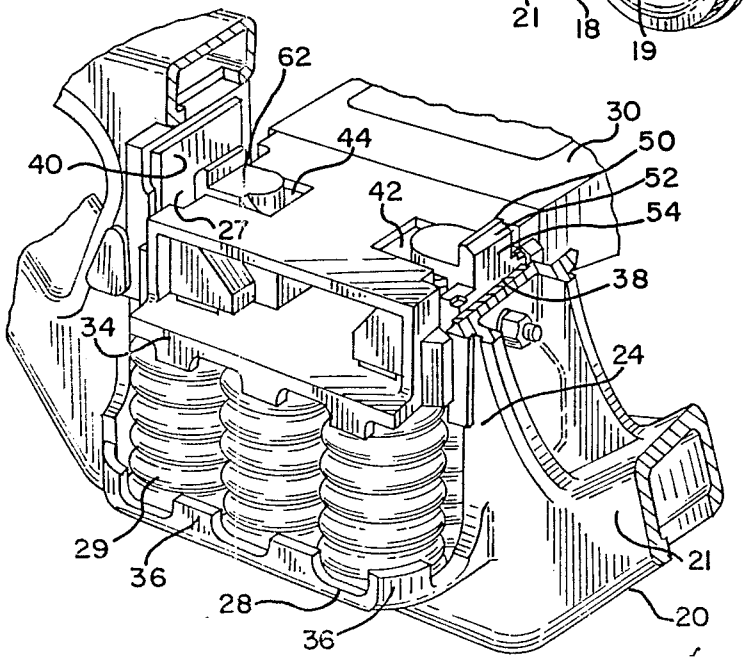
FIG. 2 is an enlarged detailed, partially cut away perspective view of the interface between the truck bolster end and the side frame column bolster opening.
Figure 3:
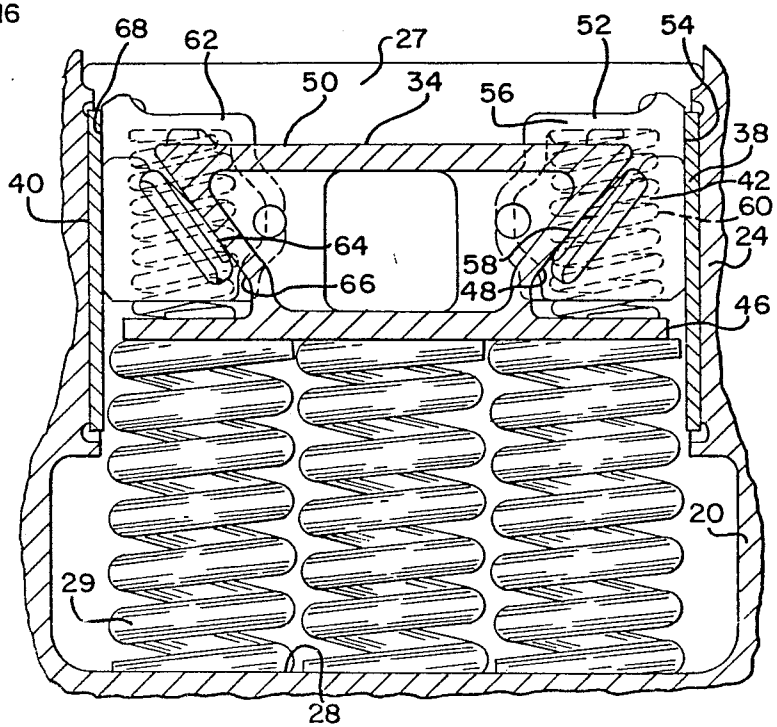
FIG. 3 is an enlarged, detailed, partially cut away end elevation view of the bolster end received in the side frame column bolster opening.

Referring now to FIGS. 2 and 3, detailed views of a typical bolster end 34 extending through side frame bolster opening 27 are shown. Bottom spring support shelf 28 of side frame 20 is seen to comprise upraised sections 36 adapted to receive coil springs 29 in a prearranged pattern. Side frame columns 24 are seen to have bolted and/or welded wear plates 38 and 40 on the surfaces facing bolster opening 27. Both side frame column friction wear plates 38 and 40 are generally planar and extend in a generally vertical direction. Such wear plates provide a replaceable surface against which a snubbing force from friction shoes 52 and 62 can be directed without structural wear on side frame columns 24.

Bolster end 34 is seen to include two friction shoe pockets 42 and 44. Friction shoe pockets 42 and 44 are mirror images of each other and accordingly friction shoe pocket 42 will be described in detail. This friction shoe pocket 42 extends inwardly into a longitudinal edge of bolster end 34 and includes a base section 46 and sloped walls 48 extending downwardly at an acute angle from upper surface 50 of bolster 30. A friction shoe 52 is received within friction shoe pocket 42. In the construction illustrated, friction shoe 52 comprises a cast metal body including a generally planar, generally vertical front face 54, a central roof section 56 extending backward from a top section of friction shoe 52, and two sloped surfaces 58 (the other sloped surface not being visible on friction shoe 52) extending downwardly at an acute angle from an upper portion of front face 54. Control spring 60 is received within an opening in the bottom of friction shoe 52 and extends upwardly and contacts the lower section of roof portion 56 of friction shoe 52. Control spring 60 has a bottom edge resting on base section 46 of friction shoe pocket 42 in bolster 30. Friction shoe 62 is received in friction shoe pocket 44 and is identical to friction shoe 52. For clarity, a sloped surface 64 of friction shoe 62 is shown.

As railway truck 10 travels down a railway track with the freight car supported thereon, bolster 30 is subjected to oscillations within the side frame-bolster openings 27. Such oscillations are accommodated by coil spring group 29, with friction shoes 52 and 62 acting to damp oscillating movement of bolster 30 in side frame 20. Such damping is provided by vertical friction wall 54 of friction shoe 52 and a similar wall of friction shoe 62 rubbing against side frame column friction plates 38 and 40 respectively. Further, sloped surfaces 48 (other surface not shown) of bolster end 34 contact corresponding sloped surfaces 58 (other sloped surface not shown) of friction shoe 52. Sloped surfaces 66 (other surface not shown) of bolster end 34 contact corresponding sloped surfaces 64 (other sloped surface not shown) of friction shoe 62. Sloped surfaces 58 and 64 of friction shoes 52 and 62 typically extend at angles between 30 and 45 outwardly from front vertical faces 54 and 68 so as to correspond to the original condition sloped surfaces 48 and 66 of bolster end 34 which are cast to extend at similar angles from the vertical.

Figure 4A:
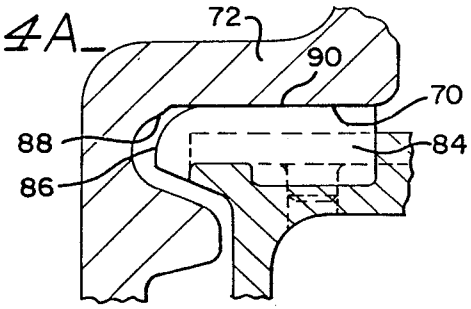
FIG. 4A is a cross-sectional view taken along lines 4A—4A of FIG. 4.

While the railway vehicle is in service, sloped surfaces 58 and 64 of friction shoes 52 and 62 wear away the metal of sloped surfaces 48 and 66 respectively of bolster end 34 resulting in an overall reduction in the thickness of bolster sloped surfaces 48 and 66 and causing friction shoes 52 and 62 to rise leaving control springs 60 with less damping ability. As this wear occurs, friction shoes 52 and 62 continue to rise in friction shoe pockets 42 and 44 resulting in greater wear at the top portion of bolster sloped surfaces 48 and 66. A service worn sloped surface 70 of a bolster end 72 is shown in FIGS. 4 and 4A.

Figure 5:
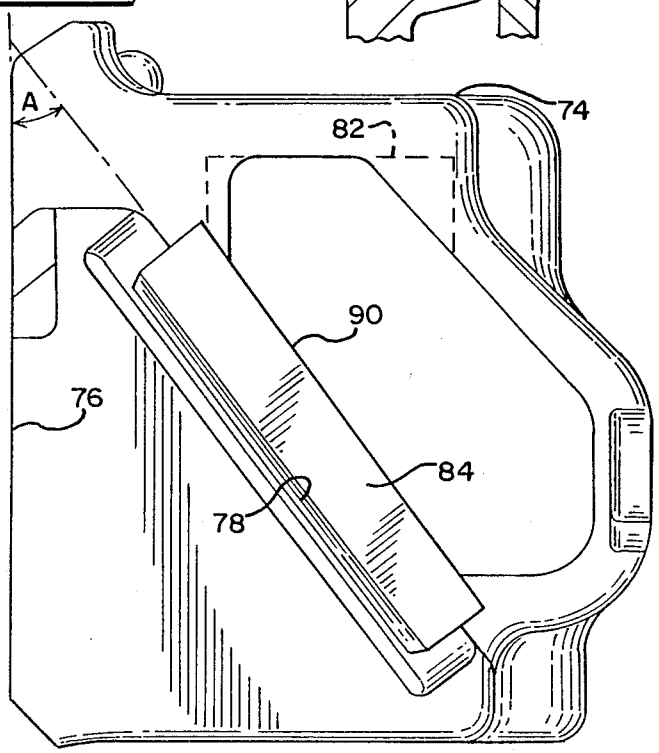
FIG. 5 is a side elevation view of a friction shoe in accordance with the present invention.
Figure 4:
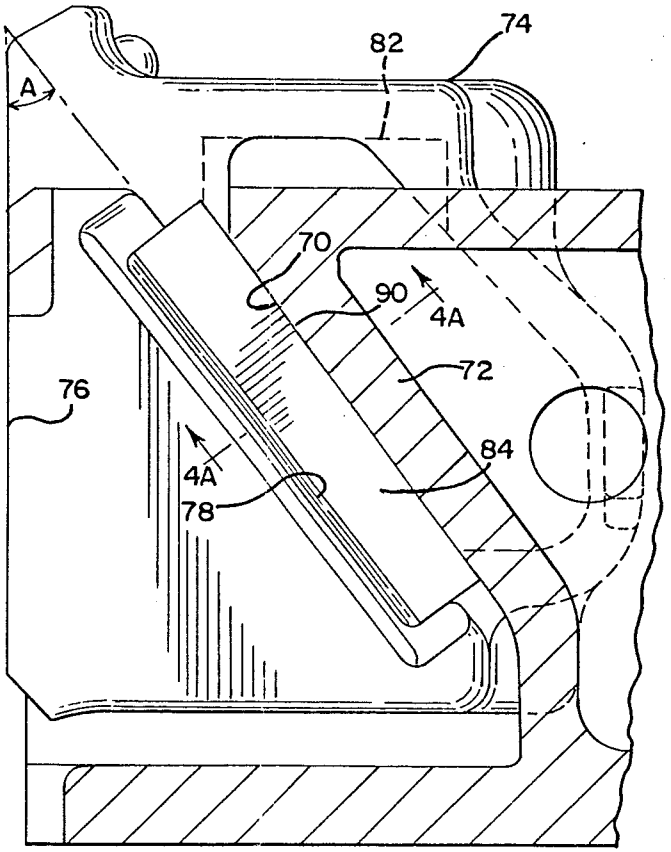
FIG. 4 is a side elevation view of a friction shoe in accordance with the present invention shown abutting a service worn sloped surface of a bolster end.
Figure 6:
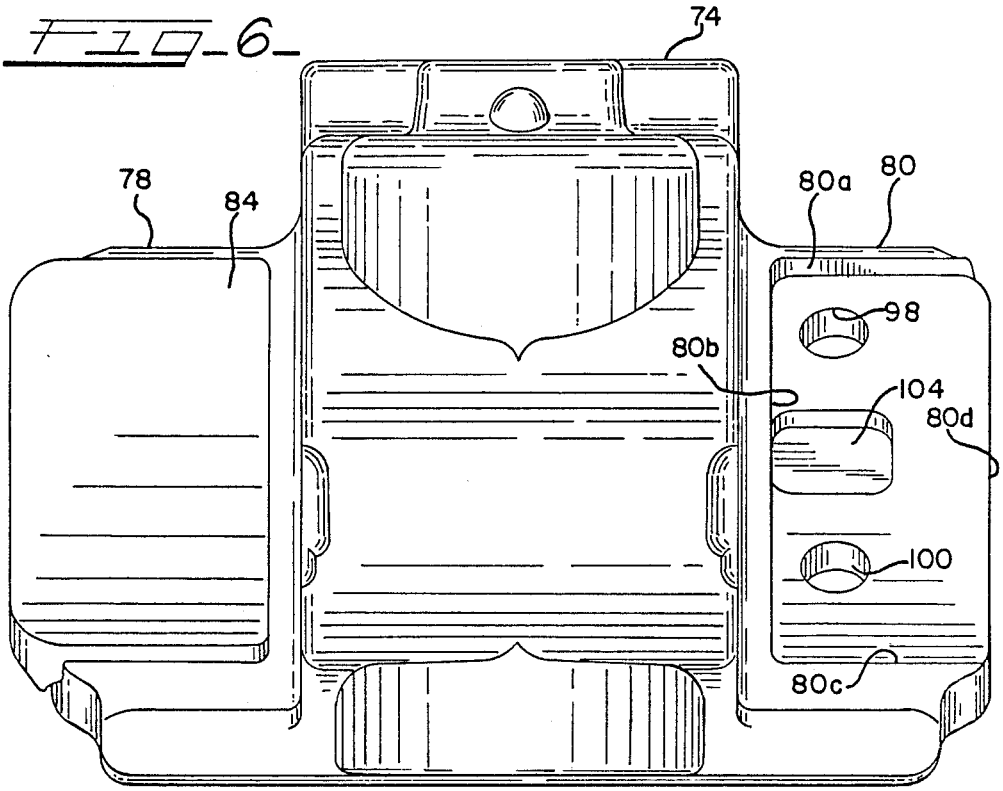
FIG. 6 is a rear elevation view of the friction shoe shown in FIG. 5.

Referring now to FIGS. 4–6 of the drawings, a preferred embodiment of a friction shoe constructed in accordance with the present invention is shown generally at 74. Friction shoe 74 is comprised of a cast metal body having a generally flat vertical front face 76 and sloped surfaces 78 and 80 extending outwardly toward either side with elastomeric pads 84 thereon. A cavity 82 is provided within friction shoe 74 to accommodate the control spring (not shown). Sloped surfaces 78 and 80 extend at an angle A, which may conveniently conform to the typical angle of between 30 and 45 from vertical face 76. Sloped surfaces 78 and 80 each include three raised edges to receive and retain the elastomeric pad in a seated manner such as is shown at 84 and in detail in FIGS. 5 and 6. Sloped surface 80 is shown without an elastomeric pad and sloped surface 78 is shown with an elastomeric pad 84. Sloped surface 80 has three raised edges 80*a*, 80*b*, and 80*c* for surrounding an elastomeric pad and side 80*d* which is free and open for overlapping by an elastomeric pad. Elastomeric pad 84 is shown overlapping the outside edge of sloped surface 78. Raised edges 80*a*, 80*b* and 80*c* are of such height so as to preclude excessive compression and shearing deformation of elastomeric pad 84 under load.

Figure 8:
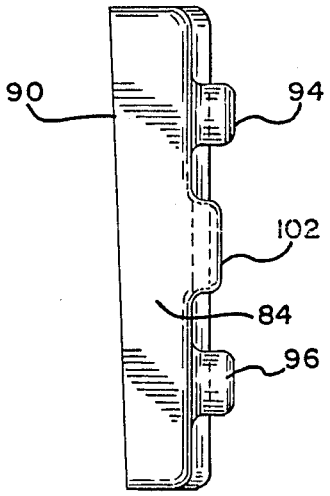
FIG. 8 is a side elevation view of the elastomeric pad shown in FIG. 7.
Figure 7:
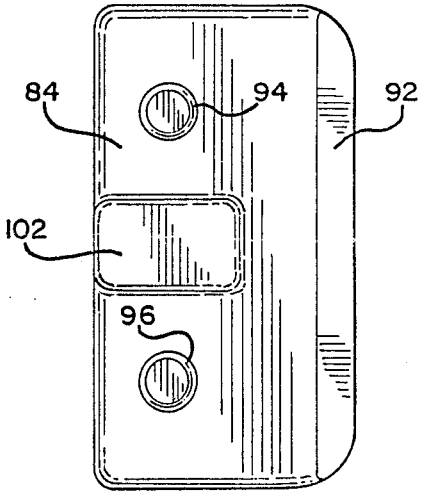
FIG. 7 is a bottom plan view of an elastomeric pad in accordance with the present invention.

Elastomeric pad 84 is shown in detail in FIGS. 7 and 8. Elastomeric pad 84 has a trapezoid shaped cross-section as shown in FIG. 8 having a greater thickness at its upper end than its lower end such that, upon securing elastomeric pad 84 to sloped surface 78, the top surface 90 of elastomeric pad 84 corresponds to abutting service worn sloped surface 70 of bolster end 72. Elastomeric pad 84 is also thicker in its overall cross-section than a prior art elastomeric pad in order to accommodate the overall reduction in thickness that has occurred in worn sloped surface 70 of bolster end 72. A raised lip 92 is included along the periphery of the side of elastomeric pad 84 which overhangs sloped surfaces 78 and 80 to preclude further metal to metal contact between these edges of friction shoe 74 and bolster end 72. Elastomeric pad 84 is retained within sloped surface 80 by two cylindrical-shaped projections 94 and 96 which are integrated within elastomeric pad 84 and which are received by corresponding apertures 98 and 100 in sloped surface 80. Further rigidity and preclusion of movement in the direction of the side of the elastomeric pad 84 which overlaps sloped surfaces 78 and 80 is provided by rectangular-shaped projection 102 which is also integrated within elastomeric pad 84 and which is received by corresponding shaped notch 104 in sloped surface 80. A large external radius 86 along the top surface 90 of the overhanging edge of the elastomeric pad 84 is provided to avoid contact with non-worn ridge 88 of the sloped surface of bolster end 72 which appears adjacent to service worn sloped surface 70 as service worn sloped surface 70 is formed. Such contact between elastomeric pad 84 and non-worn portion 88 could result in precluding proper seating of pad 84 as well as the possible gouging of pad 84.

To repair a rail truck where the sloped surface of the bolster end has become deformed by in service wear under the present invention, the replaceable portions of the old friction shoe assembly including friction shoes 52 and 62, control springs 60, and vertical wear plates 38 and 40 are first removed. Rather than restoring the service worn sloped surfaces such as 70 of bolster end 72 with weld material, a new friction shoe assembly including friction shoes of the type shown generally at 74 with trapezoid shaped elastomeric pads 84, control springs and vertical wear plates are installed. The top surface 90 of elastomeric pad 84 corresponds to abutting service worn sloped surface 70 of bolster end 72 and the overall thickness of elastomeric pad 84 is greater in order to restore the damping force to that of a new friction shoe assembly.

While a friction shoe with two sloped surfaces is shown in the drawings and discussed hereinabove, it is to be understood that the invention is applicable to a friction shoe having only one sloped surface.

The foregoing description and drawings explain and illustrate the best known mode of the invention and those skilled in the art who have the disclosure before them will be able to make modifications and variations therein without departing from the spirit and scope of the invention which is defined in the following claims.

We claim:

1. A method of repairing a railway truck having a friction shoe assembly against which an abutting sloped surface of a truck bolster end has become worn during service, said method comprising the following steps:

removing the existing friction shoe assembly; and installing a new friction shoe assembly, said new friction shoe assembly including a friction shoe having a metal base section with a generally vertical, generally planar front face and at least one sloped surface extending downwardly at an acute angle in relation to an upper portion of said front face, and elastomeric pad means one of each received on each said sloped surface of said friction shoe for abutment to said corresponding sloped surface of said bolster end, said sloped surface of said friction shoe adapted to receive and retain said elastomeric pad, said elastomeric pad being trapezoid shaped in cross-section having a greater thickness at its upper end than its lower end and having an overall thickness such that, upon insertion of said elastomeric pad into said sloped surface of said friction shoe, a top surface of said elastomeric pad is adjacent to said abutting service worn sloped surface of said bolster end, thereby restoring said friction shoe to its original damping position.

2. The method of claim 1 wherein said sloped surface of said friction shoe further comprises three raised edges for receiving and retaining said elastomeric pad in a seated manner, said three raised edges surrounding the periphery of said elastomeric pad on three sides and being of such height as to preclude excessive compression and shearing deformation under load.

3. The method of claim 2 wherein said elastomeric pad includes a raised lip along the periphery of its free side, said raised lip overhanging said sloped surface of said friction shoe to preclude contact of the corresponding edge of said sloped surface of said friction shoe with said bolster end.

4. The method of claim 2 wherein said elastomeric pad further comprises two cylindrical-shaped projections which are seated within two apertures in said sloped surface of said friction shoe corresponding to the shape and location of said cylindrical projections, said receipt of said projections within said apertures further retains said elastomeric pad on said sloped surface of said friction shoe.

5. The method of claim 2 wherein said elastomeric pad further comprises a rectangular-shaped projection which is seated within a notch in said sloped surface of said friction shoe corresponding to the shape and location of said rectangular projection, said receipt of said projection within said notch to provide further rigidity and preclude movement of said elastomeric pad in the direction of its free side.

6. The method of claim 2 wherein said elastomeric pad further comprises an enlarged external radius along said top surface of said free side to avoid contact with a non-worn ridge which appears adjacent to said service worn sloped surface of said bolster end during formation of said service worn sloped surface.

7. A friction shoe assembly for use in repair of a railway truck in which an abutting sloped surface of a truck bolster end has become worn during service, said friction shoe assembly comprising:

a friction shoe having a metal base section having a generally vertical, generally planar front face and at least one sloped surface extending downwardly at an acute angle in relation to an upper portion of said front face, and elastomeric pad means one of each received on each said sloped surface of said friction shoe for abutment to said corresponding sloped surface of said bolster end, said sloped surface of said friction shoe adapted to receive and retain said elastomeric pad, said elastomeric pad being trapezoid shaped in cross-section having a greater thickness at its upper end than its lower end and having an overall thickness such that, upon insertion of said elastomeric pad into said sloped surface of said friction shoe, a top surface of said elastomeric pad is adjacent to said abutting service worn sloped surface of said bolster end, thereby restoring said friction shoe to its original damping position.

8. The friction shoe of claim 7 wherein said sloped surface of said friction shoe further comprises three raised edges for receiving and retaining said elastomeric pad in a seated manner, said three raised edges surrounding the periphery of said elastomeric pad on three sides and being of such height as to preclude excessive compression and shearing deformation under load.

9. The friction shoe of claim 8 wherein said elastomeric pad includes a raised lip along the periphery of its free side, said raised lip overhanging said sloped surface of said friction shoe to preclude contact of the corresponding edge of said sloped surface of said friction shoe with said bolster end.

10. The friction shoe of claim 8 wherein said elastomeric pad further comprises two cylindrical-shaped projections which are seated within two apertures in said sloped surface of said friction shoe corresponding to the shape and location of said cylindrical projections, said receipt of said projections within said apertures further retains said elastomeric pad on said sloped surface of said friction shoe.

11. The friction shoe of claim 8 wherein said elastomeric pad further comprises a rectangular-shaped projection which is seated within a notch in said sloped surface of said friction shoe corresponding to the shape and location of said rectangular projection, said receipt of said projection within said notch to provide further rigidity and preclude movement of said elastomeric pad in the direction of its free side.

12. The friction shoe of claim 8 wherein said elastomeric pad further comprises an enlarged external radius along said top surface of said free side to avoid contact with a non-worn ridge which appears adjacent to said service worn sloped surface of said bolster end during formation of said service worn sloped surface.

* * * * *